US009816370B2

(12) United States Patent
Beligere et al.

(10) Patent No.: US 9,816,370 B2
(45) Date of Patent: Nov. 14, 2017

(54) SYSTEM AND METHOD FOR OPTIMIZING AN OPERATION OF A SENSOR USED WITH WELLBORE EQUIPMENT

(71) Applicant: Honywell International Inc., Morristown, NJ (US)

(72) Inventors: Sudheer Beligere, Karnataka (IN); Gangi Reddy Rajula, Andhrapradesh (IN); Veeresh Shivaprakash Yagati, Karnataka (IN); Sivaprakash Eswaran, Karnataka (IN); Murali Ravipati, Karnataka (IN)

(73) Assignee: Honeywell International Inc., Morris Plains, NJ (US)

( * ) Notice: Subject to any disclaimer, the term of this patent is extended or adjusted under 35 U.S.C. 154(b) by 124 days.

(21) Appl. No.: 13/622,715

(22) Filed: Sep. 19, 2012

(65) Prior Publication Data

US 2014/0077964 A1 Mar. 20, 2014

(51) Int. Cl.

| | |
|---|---|
| ***G01V 3/00*** | (2006.01) |
| ***E21B 47/06*** | (2012.01) |
| ***E21B 47/00*** | (2012.01) |

(52) U.S. Cl.

CPC ..... *E21B 47/06* (2013.01); *E21B 47/00* (2013.01)

(58) Field of Classification Search

CPC ..... E21B 47/12; E21B 47/00; E21B 47/06
USPC ..... 340/853.3
See application file for complete search history.

(56) References Cited

U.S. PATENT DOCUMENTS

| | | | | |
|---|---|---|---|---|
| 5,924,979 | A * | 7/1999 | Swedlow | A61B 5/14551 600/300 |
| 5,983,164 | A | 11/1999 | Ocondi | |
| 6,129,746 | A * | 10/2000 | Levine | G06F 19/3418 607/27 |
| 7,676,238 | B2 * | 3/2010 | Otsuka | H04L 1/0002 455/13.4 |

(Continued)

OTHER PUBLICATIONS

Abdelgawad, A.M., Remote Measuring for Sand in Pipelines Using Wireless Sensor Network, IEEE Transactions on Intrumentation and Measurement, V60, N4, 1443-52, dated Apr. 2011.

(Continued)

*Primary Examiner* — Zhen Y Wu
(74) *Attorney, Agent, or Firm* — Conley Rose, P.C.; Kristin Jordan Harkins

(57) ABSTRACT

Apparatus and associated methods may relate to a sensor controller configured to apply predetermined criteria to determine when a parameter value sampled by a sensor module meets the predetermined criteria, and in response to making such a determination, adjust a commanded data rate including an update time period. In an illustrative example, the predetermined criteria may be independently defined for each sensor in a network. In examples with a network of sensors, the sensor controller may dictate sensor module operation at differentiated data rates. In an illustrative example, a sensor controller may communicate with a series of pressure level sensor modules connected to a drilling apparatus in a mud logging application. Upon detection of a pressure level change that exceeds a critical condition as determined through comparison with the predetermined criteria, the sensor controller may increase or decrease a data rate of the respective sensor module, for example.

17 Claims, 7 Drawing Sheets

(56) References Cited

U.S. PATENT DOCUMENTS 7,957,813 B1 * 6/2011 Persson ..... A61N 1/37276 607/32
8,022,807 B2 * 9/2011 Martin ..... G08B 25/08 340/10.2
8,095,091 B1 * 1/2012 Kopikare ..... H03G 3/3042 455/115.1
8,106,788 B2 * 1/2012 Ohl ..... G01D 3/022 340/439
8,120,509 B2 * 2/2012 Young ..... G01V 11/002 340/854.4
8,140,658 B1 3/2012 Gelvin et al.
8,172,766 B1 * 5/2012 Kayyali ..... A61B 5/02055 128/204.23
8,195,401 B2 * 6/2012 Ella ..... G06Q 10/06 702/13
2004/0121495 A1 * 6/2004 Sonderman ..... H01L 22/20 438/14
2004/0204181 A1 * 10/2004 Cromer ..... H04W 52/0277 455/574
2005/0259514 A1 * 11/2005 Iseli ..... G01V 1/223 367/79
2006/0052985 A1 3/2006 Ito et al.
2006/0074503 A1 * 4/2006 Purdy ..... H01L 22/20 700/74
2006/0176175 A1 * 8/2006 Evans ..... C25C 3/20 340/539.22
2007/0130893 A1 * 6/2007 Davies ..... A01K 11/008 54/1
2008/0204270 A1 * 8/2008 Aiello ..... E21B 47/18 340/855.4
2009/0046739 A1 * 2/2009 Ebling ..... G01D 21/00 370/465
2009/0113066 A1 * 4/2009 Van Wie ..... H04L 12/1827 709/231
2009/0185542 A1 * 7/2009 Zhang ..... G01D 3/00 370/338
2010/0027426 A1 * 2/2010 Nair ..... H04W 28/16 370/238
2010/0064337 A1 * 3/2010 Dvir ..... H04N 5/76 725/115
2011/0040503 A1 2/2011 Rogers et al.
2011/0205081 A1 8/2011 Chen et al.
2011/0245622 A1 * 10/2011 McKenna ..... A61B 5/02416 600/300
2012/0059521 A1 * 3/2012 Iversen ..... E21B 44/00 700/275
2012/0078519 A1 3/2012 Robotti et al.
2012/0313760 A1 * 12/2012 Okano ..... G06Q 50/22 340/10.1
2013/0124891 A1 * 5/2013 Donaldson ..... G06F 1/163 713/322
2013/0294284 A1 * 11/2013 Popa ..... H04L 63/065 370/254
2014/0023087 A1 * 1/2014 Czompo ..... H04W 4/02 370/465
2014/0320314 A1 * 10/2014 Gagnon ..... G01D 4/008 340/870.39

OTHER PUBLICATIONS

Cai, Li, Design and Implementation of CDMA-based Remote Monitoring and Controlling System, Proceedings of the SICE Annual Conference, p. 2445-2450, dated 2007, SICE Annual Conf.
Arshak, K, Wireless Sensor Network System for Pressure and Temperature Signals Monitoring, dated 2007, IEEE Intl. Symposium on Industrial Electronics, pp. 1496-1501, ISBN-10.
Chonggang, Wang, Priority-based Congestion Control in Wireless Sensor Networks, 1 Dept. of Elec. Engi., Univ. of Arkansas, 8 pgs, copyrighted 2006.
Nabi, Majid, Dynamic Data Prioritization for Quality-of-Service Differentiation in Heterogeneous Wireless Sensor Networks, Depart. of Elec. Eng., Eindhoven Univ. 2011, 9pgs.
Sergey, Muravyov, Prioritizing Sensed Data Transmission by Consensus Relation in Wireless Sensor Network, 12th IMEKO TC1 & TC7 Joint Symposium, Sep. 3, 2008, 6 pgs.

* cited by examiner

SYSTEM AND METHOD FOR OPTIMIZING AN OPERATION OF A SENSOR USED WITH WELLBORE EQUIPMENT

TECHNICAL FIELD

Various embodiments relate generally to a system and method for monitoring an operation of a wellbore equipment sensor and more particularly to controlling an update rate of the wellbore equipment sensor.

BACKGROUND

Sensors are widely used in the production and monitoring of many different types of products. A sensor may be used to measure a physical quantity and communicate, via a signal, the measurement to an instrument for controlling a device and/or making an observation.

The exploration and extraction of natural resources, such as oil and gas for example, has become critical to industrialized nations. At times, the extraction of the natural resources requires drilling wellbores to access the natural resources located underground. Drilling wellbores often necessitates expensive equipment. In certain circumstances, it may be important to continuously monitor the equipment to ensure safe and reliable operation.

SUMMARY

Apparatus and associated methods relate to a sensor controller configured to apply predetermined criteria to determine when a parameter value sampled by a sensor module meets the predetermined criteria, and in response to making such a determination, adjust a commanded data rate including an update time period. In an illustrative example, the predetermined criteria may be independently defined for each sensor in a network. In examples with a network of sensors, the sensor controller may dictate sensor module operation at differentiated data rates. In an illustrative example, a sensor controller may communicate with a series of pressure level sensor modules connected to a drilling apparatus in a mud logging application. Upon detection of a pressure level change that exceeds a critical condition as determined through comparison with the predetermined criteria, the sensor controller may increase or decrease a data rate of the respective sensor module, for example.

In accordance with an exemplary embodiment, a sensor controller may dictate operation of the sensor module at a defined data rate. The data rate may include the rate at which the sensor module samples the given parameter type and transmits the parameter value to the sensor controller, for example. The data rate assigned to a particular sensor module may correlate with a previous sampled parameter value as determined through comparison with predetermined criteria. For example, if a parameter value sampled by the sensor module correlates with a parameter value from the predetermined criteria that is associated with a higher data rate than is currently used by the sensor module, the data rate of the sensor module may be increased through generation of a command signal and transmission from the sensor controller. In some examples, a wireless point-to-point transmission may be used for communication between the sensor controller and the sensor modules.

Various embodiments may achieve one or more advantages. For example, some embodiments may permit prioritization of sensor modules based upon one or more zones in which the sensor modules are located or based upon a parameter type sampled, for example. In an illustrative example, a first sensor module sampling a parameter type critical to the operation of wellbore operation equipment may be given a higher priority and thus be assigned a higher data rate than a second sensor module used to sample criteria not critical to the operation of the wellbore equipment.

Other advantages may include the conservation of battery power of individual sensor modules. For example, if a static condition exists, such as no pressure level changes for a predetermined historical timeframe, a data rate of a given sensor module may be lowered such that less sampling and transmission of parameter values will occur. By lowering the data rate, less power may be consumed by the sensor module which may provide longevity to the lifeline of the battery of the sensor module.

Other advantages may provide for controlling bandwidth consumption of the sensor controller or a receiver connected to the sensor controller. For example, different sensor modules may be assigned differentiated and/or variable data rates such that the sensor modules are communicating with the sensor controller at different time periods. Since not all data is communicated to the sensor controller at once and rather spread out over greater time periods, the sensor controller may have adequate free memory to perform multiple other processing functions. For example, by distributing incoming data rates, the sensor controller may accommodate an increased number of sensor modules thus permitting a more accurate representation of sampled parameters though the increased number of sensor modules.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, a system arrangement is briefly introduced in FIG. 1. Second, with reference to FIG. 2A-2C, the discussion turns to an exemplary representation of various exemplary sensors and an exemplary controller. Finally, with reference to FIGS. 3-5, further explanatory discussion and experimental data is presented to explain system processes.

Figure 1:
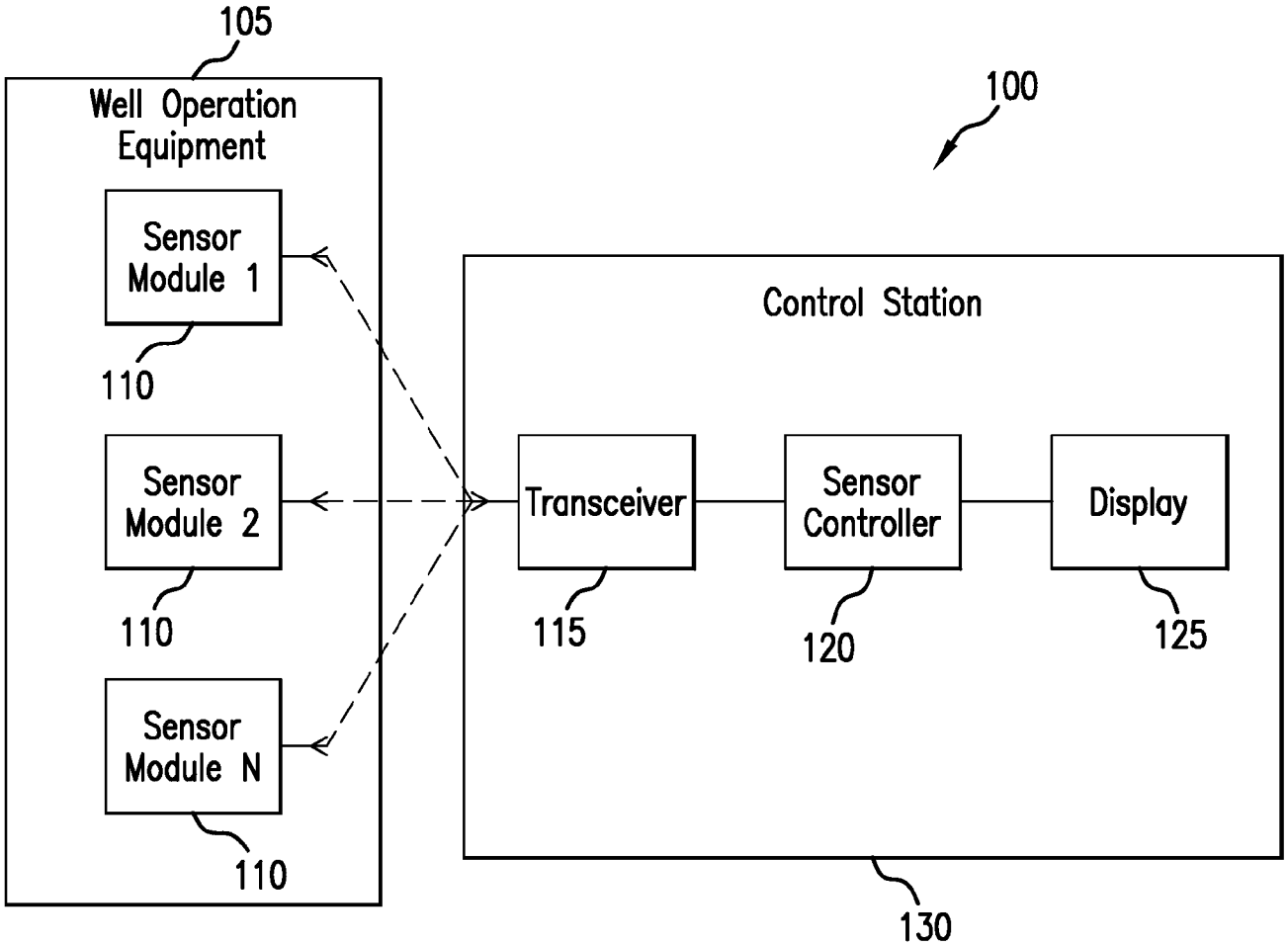
FIG. 1 depicts a flow diagram of an exemplary sensor optimization system.

FIG. 1 depicts a flow diagram of an exemplary sensor optimization system. A sensor optimization system 100 is used in conjunction with well operation equipment 105. For example, the system may be used with well operation equipment 105 in conjunction with monitoring well pressure. In another example, the system may be used with well operation equipment 105 in conjunction with monitoring temperature. The well operation equipment 105 may be a well drill apparatus or bore, for example.

The well operation equipment 105 includes one or more sensor modules 110 used in connection with the well operation equipment. In some examples, the sensor modules 110 may be attached directly to the well operation equipment 105 at various locations. In some examples, the sensor modules 110 may be located proximate to a location where the well operation equipment is, historically has been, or is projected to be. The sensor modules 110 may monitor pressure levels in some examples. In other examples, the sensor modules 110 may monitor temperature levels. In some examples, a first sensor module 110 may sample a first parameter at a first data rate and a second sensor module 110 may sample a second parameter at a second data rate.

Each sensor module 110 may separably communicate through a transceiver 115 capable of transmitting and receiving messages. In some examples, the sensor modules 110 and the transceiver 115 communicate wirelessly in a point-to-point type communication. In some examples, the sensor modules 110 may be connected in a daisy-chain configuration and wirelessly communicate one-signal to the transceiver 115. In other examples, a direct-wired connection may be employed between one or more sensor modules 110 for communication purposes.

The transceiver 115 is connected to a sensor controller 120 for processing sampled parameters and evaluating current data rates from the sensor modules 110. The sensor controller 120 as shown controls a network of sensor modules 110. The sensor controller 120 may evaluate incoming data and generate command signals to be redistributed to respective sensor modules 110 depending upon a current condition of the well operation equipment and/or the sampled environment. Also connected to the sensor controller 120 is a display 125 for permitting an operator to view incoming and outgoing data results. In some examples, an operator viewing the data results may manipulate or directly input outgoing command signals to one or more sensor modules 110.

The transceiver 115, sensor controller 120, and display 125 may be located external to the well operation equipment, such as at a control station 130. The control station 130 may be located on-site near a ground level proximate to the well operation equipment, for example. In some examples, the control station 130 may be located off-site, non-proximate to the well operation equipment. When communicating signals of certain distances, a relay device may be used to ensure proper signal strength so as to transmit and receive communication signals effectively. In some examples, the sensor modules 110 and/or receiver may incorporate the use of auxiliary antenna structures and/or satellites to communicate signals.

Figure 2A:
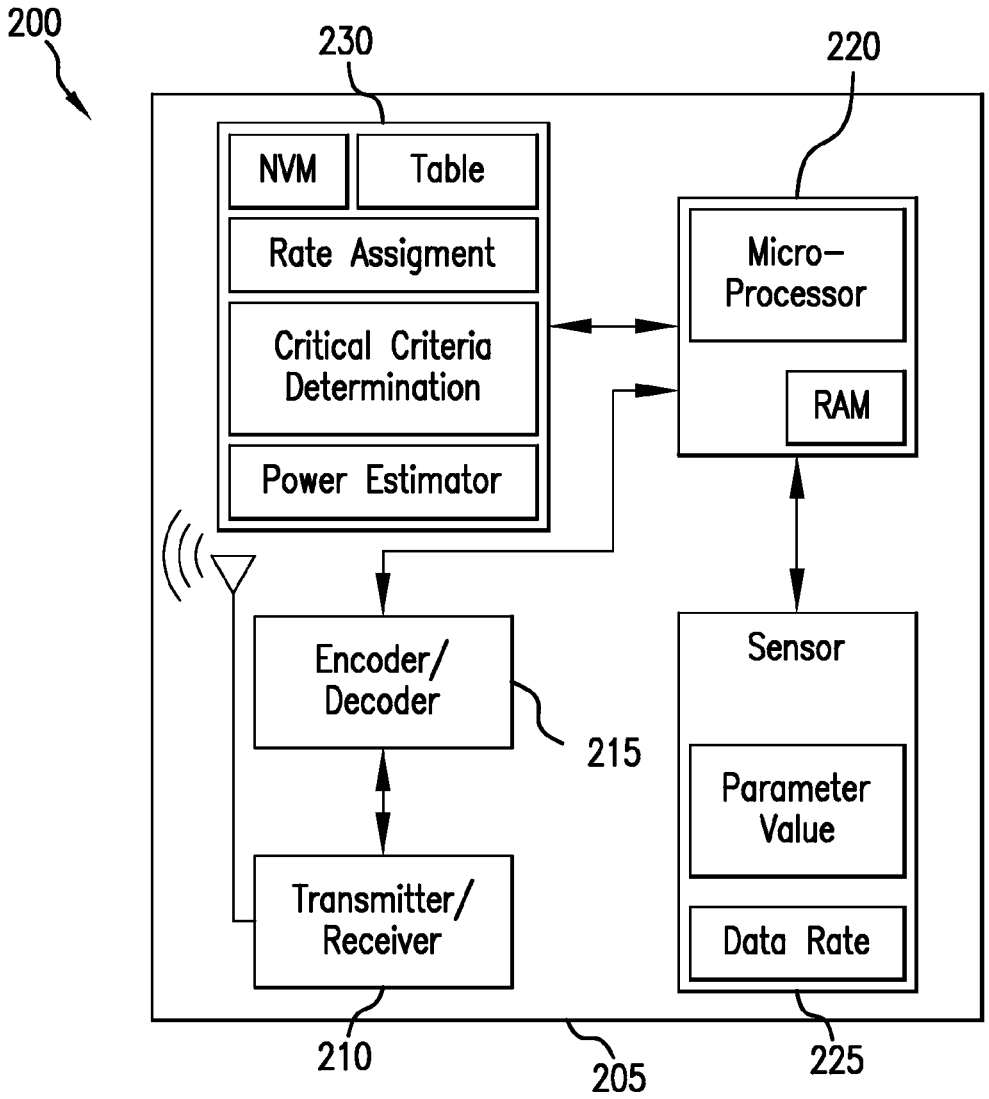
FIG. 2A depicts a schematic representation of an exemplary sensor assembly.

FIG. 2A depicts a schematic representation of exemplary sensor assembly. A sensor assembly 200 includes a sensor controller 205. The sensor controller 205 includes circuitry and software program code for receiving signals, evaluating parameters and data rates against predetermined values, and generating command signals to adjust data rates.

The sensor controller 205 includes a transmitter/receiver 210 for receiving and transmitting signals. In some examples, the transmitter/receiver 210 may receive and transmit signals in a wireless manner through one or more wireless communications channels. Connected to the transmitter/receiver 210 is an encoder/decoder 215 for decoding incoming signals and encoding outgoing signals in a predetermined format. Connected to the encoder/decoder 215 is a processing unit 220 having a micro-processor and random-access memory (RAM). The processing unit 220 processes incoming and outgoing signals. Connected to the processing unit 220 is a sensor identification unit 225. The sensor identification unit 225 identifies parameter values and current data rates for evaluation and for historical record keeping for each individual sensor module.

Also connected to the processing unit 220 is an evaluation unit 230. The evaluation unit 230 has non-volatile memory (NVM), a database table, and functions for rate assignment, critical criteria determination, and power estimator. The database table has a plurality of stored predetermined parameter values, ranges, or thresholds each associated with one or more data rates. For example, a pressure level being of a critical state determined by a high percentile level relative historical well pressure levels, such as 90%, is associated with a high frequency data rate of 0.1 seconds, for example.

The data rate is the rate at which the parameter value is sampled by the sensor module and transmitted to the sensor controller 205. As appreciated, the higher the data rate, the more power that is required by the sensor module to continue operation for a predetermined amount of time. Since the sensor modules may be off-site or deep underground, for example, replacing batteries upon the sensor modules may be time consuming and costly. Thus, the data rate assigned may be of a lesser frequency for low percentile pressure levels. For example, a pressure level having a normal or non-critical value may be associated with a data rate of 1 second, thus substantially reducing the data rate and thus power consumption of the sensor module for non-critical conditions.

The evaluation unit 230 compares parameter values and data rates received from the sensor module and makes a comparison with the database table to determine rate assignment and whether a critical condition exists. In some examples, where power must be conserved on the sensor module for a predetermined amount of time, a power estimator function may provide adjustments to the rate assignment to ensure an assigned data rate is not too high of a frequency such that all power will be consumed prior to a desired sensor module operation and may also provide adjustments to the rate assignment to ensure an assigned data rate is not too low of a frequency such that all an excessive amount of power will remain post sensor module operation. If the well operation equipment ceases to operate, the sensor controller 205 may assign the data rate to 0 such that the sensor module ceases to operate.

The evaluation unit 230 may also adjust data rates dependent upon a current or capable bandwidth of the sensor controller 205. For example, if a data bandwidth of the sensor controller 205 is reaching an upper limit, data rate frequencies may be lowered on all sensor modules or lowered on some non-critical sensor modules. If substantial data bandwidth is available, data rate frequencies may be increased to store additional parameter values.

Figure 2B:
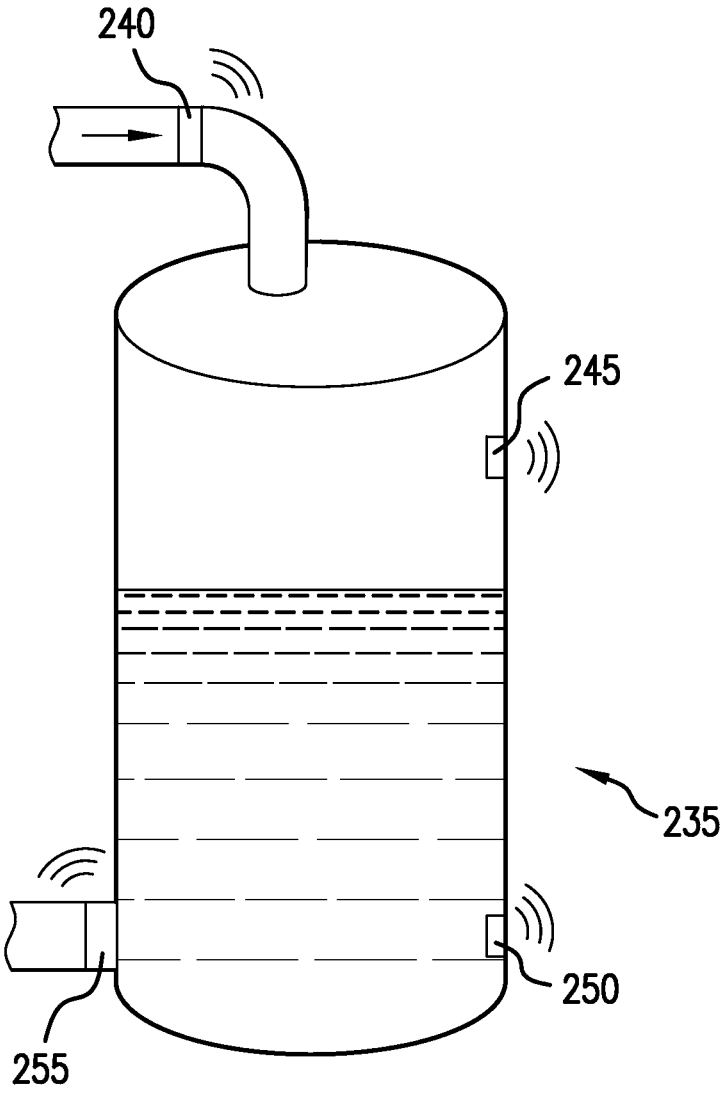
FIG. 2B depicts a schematic representation of an exemplary holding/receiving tank.

FIG. 2B depicts a schematic representation of an exemplary holding/receiving tank. Different types of equipment may employ sensor modules to communicate with the sensor controller as exemplary depicted in FIG. 2*a*. A first well operation equipment type may be a receiving/holding tank 235. A sensor module 240 may sample flow rates of a fluid entering the well operation equipment 235. A sensor module 245 may sample pressure levels within the well operation equipment 235. A sensor module 250 may sample temperature levels of the fluid within the well operation equipment 235. A sensor module 255 may sample flow rates of a fluid exiting the well operation equipment 235. All sensors 240, 245, 250, 255 may communicate separably with the sensor controller at similar or different data rates. Likewise, the sensor controller may assign new data rates to each individual sensor based upon relative criteria to the respective sensor module 240, 245, 250, 255.

Figure 2C:
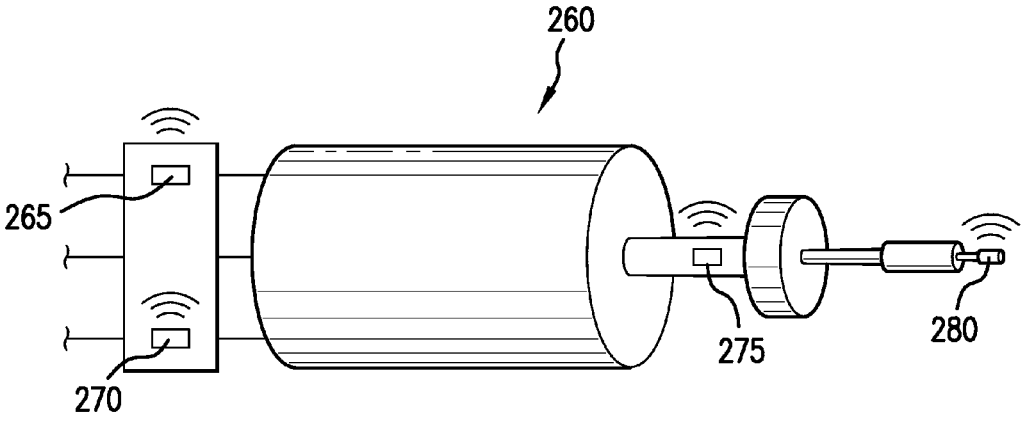
FIG. 2C depicts a schematic representation of an exemplary drive mechanism.

FIG. 2C depicts a schematic representation of an exemplary drive mechanism. A second well operation equipment type may be a drive mechanism 260 as exemplary depicted in FIG. 2A. A sensor module 265 may sample voltage levels at the input of the well operation equipment 260. A sensor module 270 may sample amperage levels at the input of the well operation equipment 260. A sensor module 275 may sample torque levels of the well operation equipment 260. A sensor module 280 may sample speed rates of the well operation equipment 260. All sensors 265, 270, 275, 280 may communicate separably with the sensor controller at similar or different data rates. Likewise, the sensor controller may assign new data rates to each individual sensor based upon relative criteria to the respective sensor module 265, 270, 275, 280.

Figure 3:
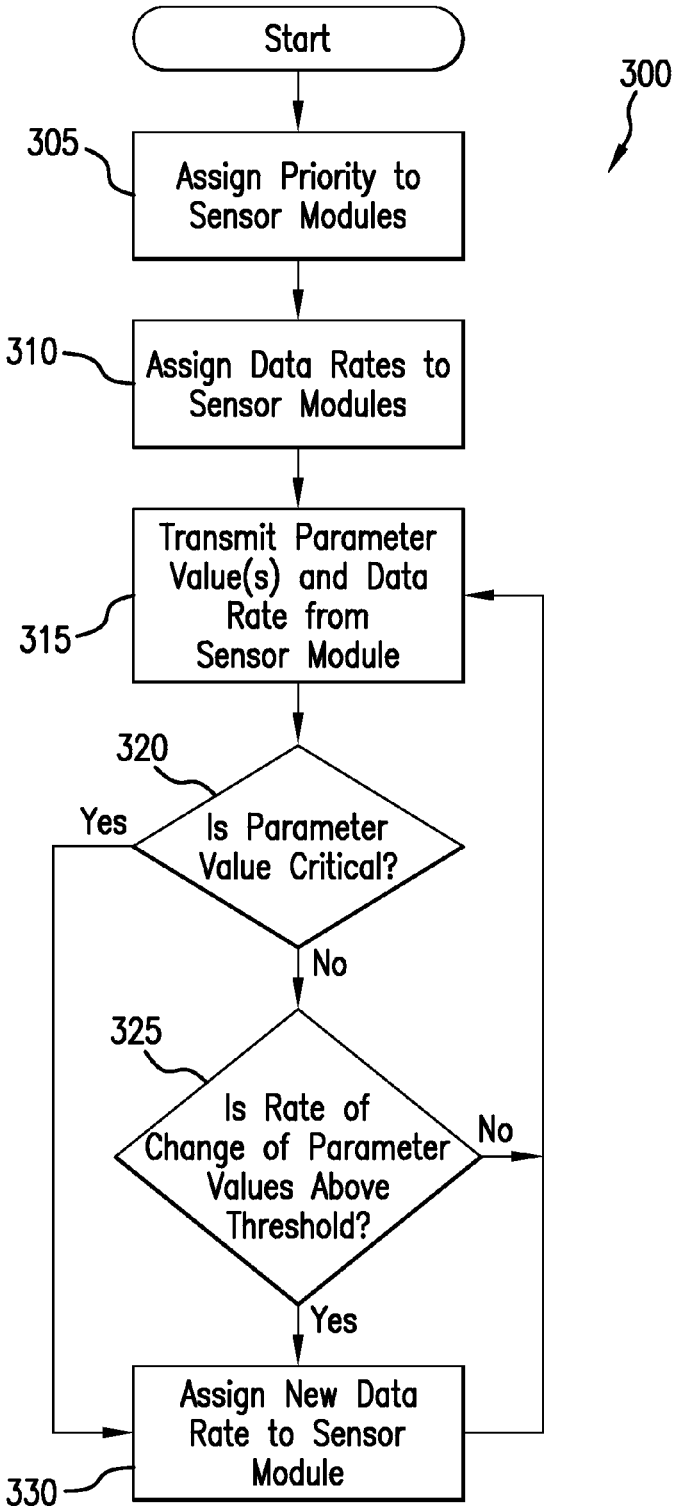
FIG. 3 depicts a flow chart of an exemplary system operation.

FIG. 3 depicts a flow chart of an exemplary system operation. A system operation 300 includes steps to determine whether a new data rate should be assigned to a particular sensor module. Each sensor module is assigned a priority value as shown in step 305 and a data rate as shown in step 310. For example, each sensor module is prioritized depending upon the criticality of the parameter being sensed by the respective sensor module. Sensor modules having high priority may receive low node numbers and sensor modules being not critical may receive high node numbers, for example. The sensor controller may call upon the low node numbers first in one example. In another example, sensor modules having low node numbers may default to a higher frequency data rate such that the sensor module samples respective parameter values and transmits the parameter values to the sensor controller more frequently.

As shown in step 315, the sensor module transmits respective sampled parameter values and a respective data rate. The sensor module may transmit the parameter values and data rate to a sensor controller for example. In some examples, a wireless transmission may be used for transferring parameter values and data rates. For example, the parameter values and data rates may be transmitted via a point-to-point wireless communication. For example, in a point-to-point communication each sensor module may communicate separately with a sensor controller such that separate data rates may be utilized and assigned to respective sensor modules.

Once the parameter values and data rates are received, the parameter values are evaluated to ensure that a respective parameter value is not critical as shown in step 320 and a change in historical parameter values does not exceed a threshold as shown in step 325. If a parameter value exceeds a predetermined critical level or a rate of change in parameter values exceeds a predetermined threshold, a new data rate is assigned to the sensor module as shown in step 330. If a parameter value does not exceed a predetermined critical level or a rate of change in parameter values does not exceed a predetermined threshold, no new data rate is assigned to the sensor module and the sensor module retains a current data rate.

Figure 4:
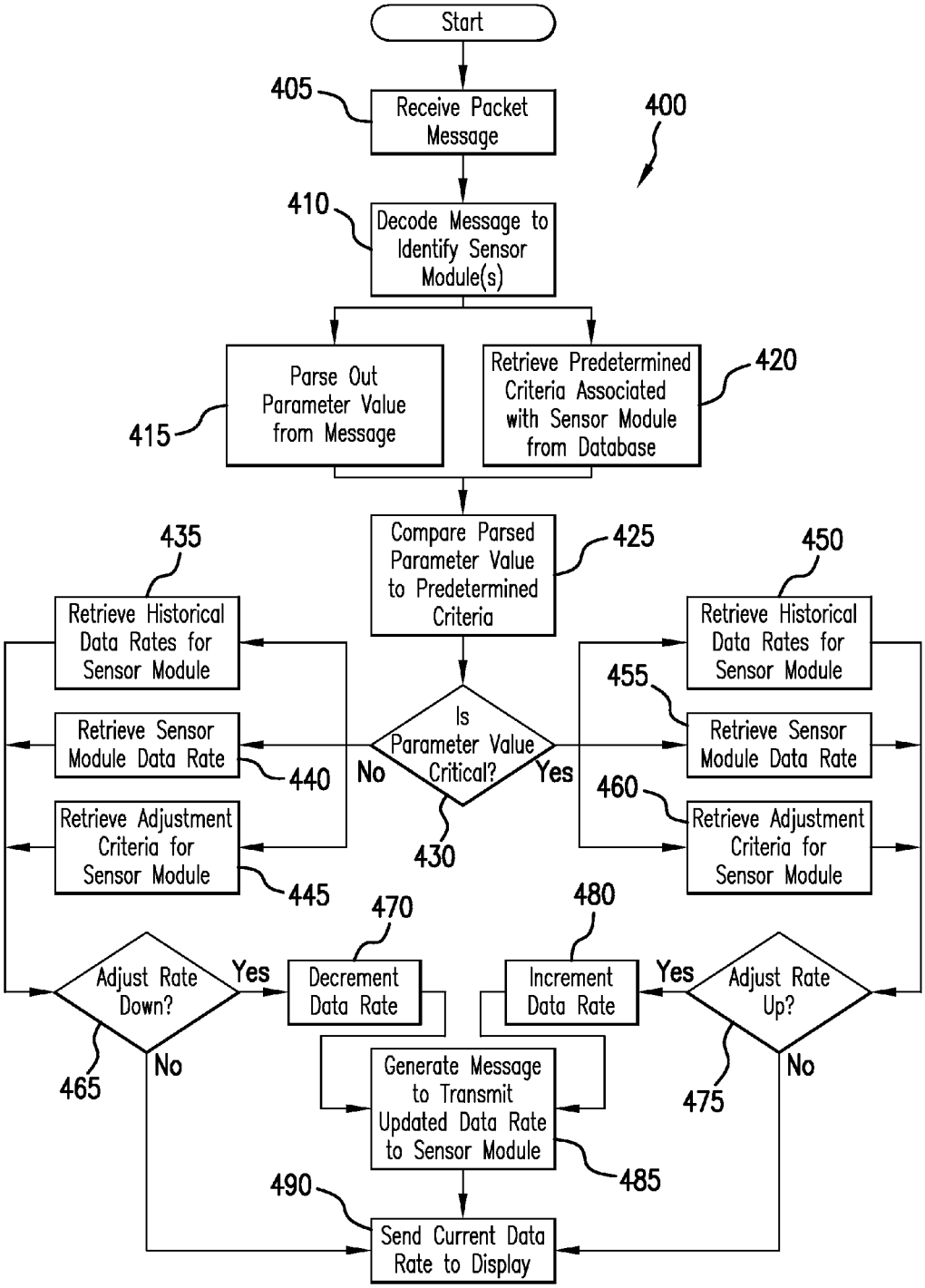
FIG. 4 depicts a flow chart of an exemplary controller operation.

FIG. 4 depicts a flow chart of an exemplary controller operation. A sensor controller operation 400 includes steps to determine whether a new data rate should be assigned to a particular sensor module. The sensor controller first receives a packet message having parameter value and data rate information as shown in step 405. The packet message may also include a sensor identifier to route the parameter evaluation correctly to correlate with a respective comparison data. Additionally, parameter values and/or data rates from a respective sensor may be stored for historical evaluation purposes, for example. The packet message may be transmitted in a wireless manner, for example.

The message is then decoded to identify a respective sensor module as shown in step 410 and the parameter value information is parsed out from the message as shown in step 415. The sensor controller also retrieves predetermined criteria associated with the respective sensor module and parameter type from a database as shown in step 420. The sensor controller may include a plurality of database tables, each for a particular parameter type or for a particular environment, for example. In some examples, the parameter type may comprise pressure values, such as the pressure of a well bore. In some examples, the parameter type may comprise temperature values.

Next, the parsed parameter value is compared with the predetermined criteria retrieved from the database table as shown in step 425 and a determination is made as to whether the sampled parameter value parsed from the sensor module is critical as shown in step 430. Once the parameter is determined critical or not, a series of steps 435, 440, 445, 450, 455, 460 may be performed to determine whether the data rate should be adjusted. The sensor controller may retrieve and review historical data rates for the sensor module as shown in steps 435, 450. For example, the sensor controller may review the past 10 data rates retrieved from the respective sensor module. The sensor controller also retrieves the current data rate assigned to the sensor module as shown in steps 440, 455 and any adjustment criteria assigned to the sensor module as shown in steps 445, 460. For example, a sensor module may have adjustment criteria including a particular priority which may require a higher data rate.

If the parameter value is deemed not critical, the sensor controller determines whether the data rate should be adjusted down as shown in step 465. To make the determination, the sensor controller reviews current and prior sensor data rate information as shown in steps 435, 440, 445 in combination with respective predetermined data rates from the database. If the current data rate is determined to be too high, the data rate is decremented down as shown in step 470.

Likewise, if the parameter value is deemed critical, the sensor controller determines whether the data rate should be adjusted up as shown in step 475. To make the determination, the sensor controller reviews current and prior sensor data rate information as shown in steps 450, 455, 460 in combination with respective predetermined data rates from the database. If the current data rate is determined to be too low, the data rate is incremented up as shown in step 480.

If the data rate is adjusted, the sensor controller generates a message to transmit the updated data rate to the sensor module as shown in step 485. The message may be transmitted in a wireless manner, for example. If the data rate is not to be adjusted, the sensor module may continue to operate at a current data rate without confirmation from the sensor controller, for example. The sensor controller may also send an adjusted or pre-existing data rate to a display for operator view as shown in step 490. The display may also show parameter values sampled currently and historically by the sensor module and respective data rates, for example.

Figure 5:
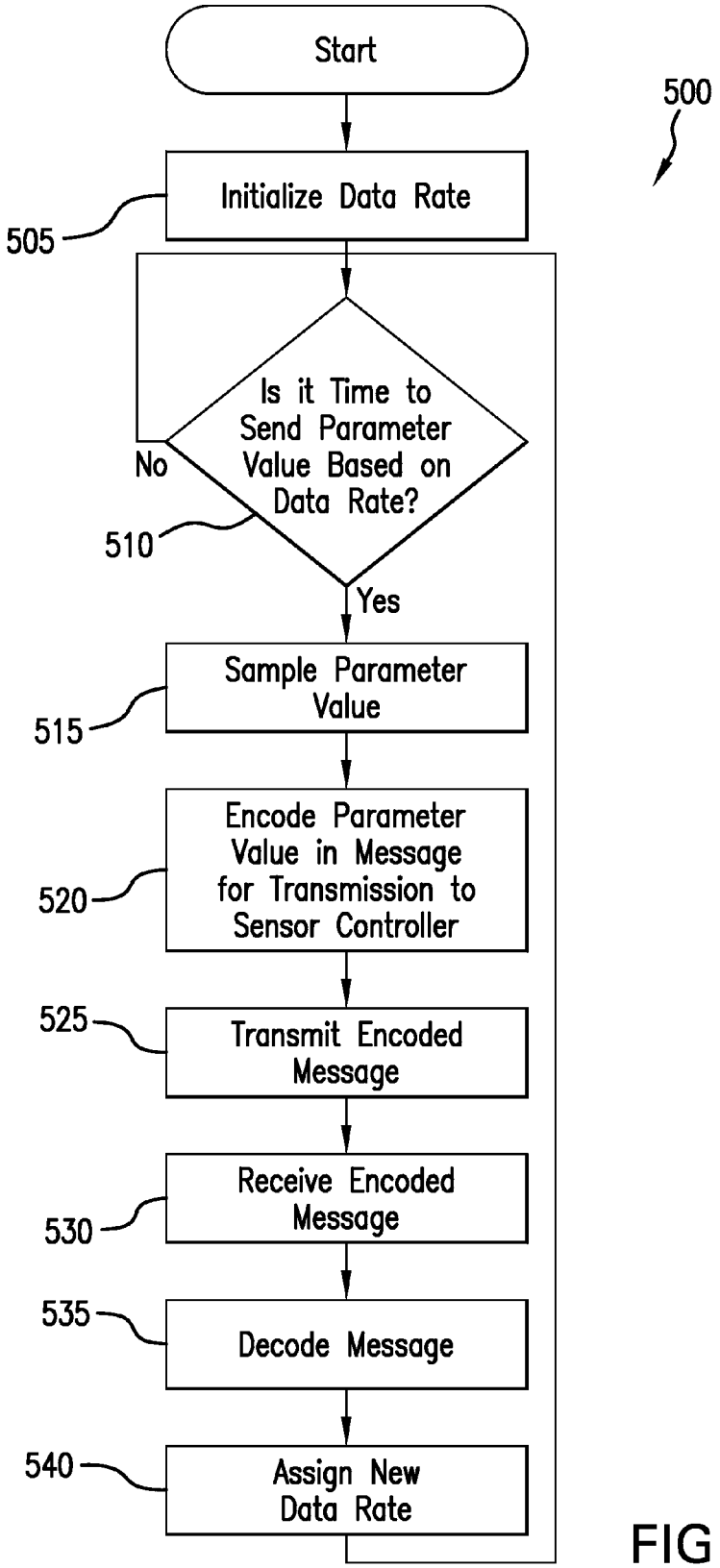
FIG. 5 depicts a flow chart of an exemplary sensor-controller communication routine.

FIG. 5 depicts a flow chart of an exemplary sensor-controller communication routine. A communications routine 500 includes a series of steps for communication between a sensor module and a sensor controller when a new data rate is assigned. First, a sensor module initializes a data rate as shown in step 505. The sensor module then waits a predetermined period before sampling a parameter value as shown in step 510. Once the predetermined period has elapsed, the sensor module samples the parameter value as shown in step 515. The parameter value is then encoded in a message for transmission to the sensor controller as shown in steps 520 and 525. The encoded message may include a sampled parameter value, a current data rate, as well as a sensor module identifier and any adjustment criteria.

The sensor controller then receives the encoded message as shown in step 530 and proceeds to decode the message as shown in step 535. The sensor controller may decode the message to parse out parameter value(s) and a data rate, for example. The sensor controller may then compare a sampled parameter value with a predetermined parameter value from a stored database table to determine if the sampled parameter value is within a critical threshold thus putting equipment that the sensor module is monitoring in a critical condition. If the sensor module is determined to be in a critical condition, a new data rate is assigned as shown in step 540 and transmitted to the sensor module such that the sensor module will then continue to operate at the new data rate.

Although various embodiments have been described with reference to the Figures, other embodiments are possible. For example, a sensor controller may dynamically allocate priority to sensor modules within one or more zones to determine an initial data rate. The sensor controller may assign high data rates to a first and second sensor module in a first zone classified as high priority, for example. The sensor controller may also assign low priority data rates to a third and fourth sensor module in a second zone classified as low priority, for example. In some examples, the sensor controller may retain similar data rates for all sensor modules within a particular zone. For example, if either the first or second sensor module within the first zone samples a parameter value that warrants a higher data rate as determined by comparison with predetermined parameter values and associated data rates, both the first and second sensor modules may receive the updated data rate.

In various embodiments, apparatus and methods may involve a determination on whether a data rate should be changed based at least partly on a remaining voltage level of a battery powering a sensor module. For example, a data rate may be adjusted down to sample at a lower data rate if a voltage level of the sensor module battery is determined to be low or critical. If a sensor module will be no longer required, such as because of ceasing operation of connected equipment, a data rate may be incremented up to sample at a higher data rate such that all the battery power will be completely consumed at the predetermined termination of the connected equipment.

In an exemplary embodiment, one or more sensor modules are used to measure pressure level changes in media circulation systems. For example, a mud logging application may have a series of pressure sensor modules connected to a drilling apparatus and installed in specialized equipment to monitor or log the drilling apparatus activity. The pressure sensor modules may detect pressure level changes in the media circulation system which may indicate changing conditions encountered down-hole by a drill bit.

Once an operator or sensor controller is able to view the sampled pressure value, the operator or sensor controller may make adjustments to a drilling mixture pressure or drilling process as needed. The operator or sensor controller may also adjust the data rate to increase or decrease a sampling frequency of the sensor module dependent upon whether a critical condition exists, such as high pressure for example. In one example, if a pressure level reaches above 70% of span, a predetermined critical condition may exist which would warrant the sensor controller to adjust the data rate of the sensor module by generating a command signal with the new data rate and transmitting the command signal over a wireless network to the sensor module.

In accordance with another embodiment, to prevent overloading of an available bandwidth of a receiver and/or sensor controller, data rates may be set differently for different sensor modules to ensure that not all sampled parameter values are sent to the sensor controller through the receiver at once. For example, a first sensor module may have a data rate set to a first frequency and a second sensor module may have a data rate set to a second frequency, where the first frequency and the second frequency do not require sampling of parameter values at concurrent times. Because of the reduced loading on the receiver and sensor controller, other tasks may be performed without delay, such as monitoring and controlling other aspects of wellbore equipment for example. Also, by varying the data rates of sensor modules, a receiver and sensor controller may accommodate an increased number of sensor modules since the loading on the receiver and/or sensor controller will be less at any given time.

In accordance with another embodiment, during static conditions such as no change in pressure for example, a data rate may be lowered such that less sampling of respective parameter values is required. During periods having high rates of condition changes, such as rapidly changing pressure, a data rate may be set higher such that more sampling of respective parameter values is required. Historical parameter values sampled by one or more sensor modules may be stored within a database such that a determination upon rate of change of the parameter values may be made.

In accordance with an exemplary embodiment, a first sensor controller and receiver may be used to monitor and control data rates for a first group of sensor modules and a second sensor controller and receiver may be used to monitor and control data rates for a second group of sensor modules.

In accordance with another exemplary embodiment, an alarm or warning may sound or be emitted if a sampled parameter exceeds a critical value or threshold. The alarm may notify an operator that a critical condition exists thus prompting the operator to review current data rates and make a determination based upon historical data and predetermined criteria whether the data rate should be adjusted.

In accordance with another embodiment, the sensor modules and sensor controller may be used in other operations other than oil and gas well operation equipment. For example, the sensor modules may operate in conjunction with vehicle safety standards. If a vehicle is approaching an object, one or more sensor modules may sample proximity of the vehicle to the object at a higher data rate to provide an operator a warning on whether brakes should be applied, for example. If no object is proximate to the vehicle as monitored by the proximity sensor modules, the sensor modules may sample at a lower data rate, for example.

In accordance with another embodiment, the sensor module may check a predetermined threshold of one or more sensed parameters. The sensor module may then make a decision whether to change an update rate. For example, one or more sensors may include an onboard control system to change a data or update rate based upon measured parameters and predetermined thresholds. In one example, each sensor module may include a preprogrammed database having one or more pre-determined thresholds associated with one or more parameters and one or more data rates. In some examples, each sensor module may operate independently of a main sensor controller through one or more sub-controllers located onboard the sensor module or proximate the sensor module. In some examples, each sensor module may be calibrated before installation to dynamically modify an update or data rate based upon a sensed parameter compared with a predetermined threshold. In some examples, one or more sensor modules may be independently calibrated after installation through a wireless signal transmission via the sensor controller, for example. In some examples, the sensor modules may operate to modify data rates based on a comparison of sensed parameters and predetermined thresholds completely independent of the sensor controller.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. A method for optimizing a data rate of a sensor used with well operation equipment for an oil or gas well, the method comprising:

upon receipt of each transmission that comprises at least one parameter value from a sensor module by a processor executing a set of program instructions on a storage device:

receiving the at least one parameter value from the sensor module, said at least one parameter value being transmitted by the sensor module at a first data rate, wherein the at least one parameter value corresponds to a physical parameter measured by the sensor module;

receiving a predetermined parameter threshold associated with a second data rate;

comparing said at least one parameter value transmitted from said sensor module to said predetermined parameter threshold;

determining a rate of change of the at least one parameter value using a stored historical value;

receiving a predetermined rate of change threshold associated with the physical parameter;

comparing the rate of change of the at least one parameter value with the predetermined rate of change threshold;

determining whether said at least one parameter value transmitted from said sensor module is within said predetermined parameter threshold;

determining whether said rate of change is within said predetermined rate of change threshold;

immediately upon determining that said at least one parameter value transmitted from said sensor module is within said predetermined parameter threshold or that said rate of change is within said predetermined rate of change threshold:

generating a command signal for transmission, said command signal comprising said second data rate; and, transmitting said generated command signal to said sensor module to command said sensor module to transmit subsequent parameter value signals at said second data rate; and receiving a second parameter value of the subsequent parameter value signals;

determining that the second parameter value represents a static condition for the physical parameter measured by the sensor module;

generating, in response to the determination that the second parameter value represents the static condition, a second command signal for transmission, said second command signal comprising a third data rate, wherein the third data rate is lower than the second data rate; and transmitting said generated second command signal to said sensor module to command said sensor module to transmit subsequent parameter value signals at said third data rate.

2. The method of claim 1, including a step of wirelessly receiving said at least one parameter value at said first data rate.

3. The method of claim 1, including a step of wirelessly transmitting said generated command signal.

4. The method of claim 1, including a step of associating said predetermined parameter threshold with a critical condition.

5. The method of claim 4, including a step of associating said critical condition with a high pressure level.

6. The method of claim 4, including a step of associating said critical condition with a low pressure level.

7. The method of claim 4, including a step of associating said critical condition with a high temperature level.

8. The method of claim 4, including a step of associating said critical condition with a low temperature level.

9. The method of claim 1, including a step of associating a higher frequency to said second data rate than said first data rate.

10. The method of claim 1, including a step of associating a lower frequency to said second data rate than said first data rate.

11. The method of claim 1, including steps of comparing a rate change of historical said parameter values with a rate of change threshold and assigning a fourth data rate to said sensor module if said rate of change of said parameter values is greater than said rate of change threshold.

12. The method of claim 1, further including a step of generating a command signal for transmission to a second sensor module comprising a fourth data rate, said fourth data rate being different than said second data rate.

13. A computer program product tangibly embodied in a storage device as a set of program instructions that, when executed by a processor, cause the processor to cause operations to be performed to optimize a data rate of a first sensor module of a plurality of sensor modules used with well operation equipment for an oil or gas well, the operations comprising:

upon receipt of each transmission that comprises at least one parameter value from the plurality of sensor modules:

receiving the at least one parameter value from the first sensor module, said at least one parameter value being transmitted by the first sensor module at a first data rate, wherein the at least one parameter value corresponds to a physical parameter measured by the first sensor module;

receiving a predetermined parameter threshold associated with a second data rate;

comparing said at least one parameter value transmitted from said first sensor module to said predetermined parameter threshold; and, determining whether said at least one parameter value transmitted from said first sensor module is within said predetermined parameter threshold;

determining a data bandwidth for a controller, where the controller is configured to receive a plurality of transmissions from the plurality of sensor modules;

determining whether said data bandwidth for the controller is within a predetermined threshold;

immediately upon determining that said at least one parameter value transmitted from said sensor module is within said predetermined parameter threshold and that said data bandwidth is within the predetermined threshold:

generating a first command signal for transmission, said first command signal comprising said second data rate for the first sensor module; and, transmitting said generated first command signal to said first sensor module to command said first sensor module to transmit subsequent parameter value signals at said second data rate, wherein the second data rate and a data rate for a second sensor module of the plurality of sensor modules are selected not to require sampling and transmission of the at least one parameter value from the first sensor module and a second parameter value from the second sensor module at concurrent times;

receiving a second parameter value of the subsequent parameter value signals from the first sensor module;

determining that the second parameter value represents a static condition for the physical parameter measured by the first sensor module;

generating, in response to the determination that the second parameter value represents the static condition, a second command signal for transmission, said second command signal comprising a third data rate, wherein the third data rate is lower than the second data rate; and transmitting said generated second command signal to said first sensor module to command said first sensor module to transmit subsequent parameter value signals at said third data rate.

14. The computer program product of claim 13, including a step of providing a wireless communications channel for said at least one parameter value at said first data rate and said generated command signal.

15. The computer program product of claim 13, wherein the operations further include associating said predetermined parameter threshold with a critical condition.

16. The computer program product of claim 15, wherein the operations further include associating said critical condition with a high pressure level.

17. The computer program product of claim 13, wherein the operations further include associating a higher frequency to said second data rate than said first data rate.

* * * * *